US008624940B2

(12) United States Patent
Kim et al.

(10) Patent No.: US 8,624,940 B2
(45) Date of Patent: Jan. 7, 2014

(54) BACKLIGHT UNIT AND DISPLAY APPARATUS

(75) Inventors: Tae-hoon Kim, Suwon-si (KR); Sang-hoon Lee, Suwon-si (KR); Sung-jin Choi, Gunpo-si (KR); Myoung-jun Lee, Bucheon-si (KR); Pankaj Agarwal, Suwon-si (KR); Youn-hee Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 772 days.

(21) Appl. No.: 12/819,822

(22) Filed: Jun. 21, 2010

(65) Prior Publication Data

US 2011/0122167 A1 May 26, 2011

(30) Foreign Application Priority Data

Nov. 25, 2009 (KR) ..... 10-2009-0114576

(51) Int. Cl.
*G09G 5/10* (2006.01)

(52) U.S. Cl.
USPC ..... 345/690

(58) Field of Classification Search
USPC ..... 345/690, 211, 212, 214, 691
See application file for complete search history.

(56) References Cited

U.S. PATENT DOCUMENTS

| | | | | |
|---|---|---|---|---|
| 5,134,356 | A * | 7/1992 | El-Sharkawi et al. | 323/211 |
| 5,180,963 | A * | 1/1993 | El-Sharkawi et al. | 323/211 |
| 8,284,218 | B2 * | 10/2012 | Yoshida | 345/691 |
| 2006/0290298 | A1 | 12/2006 | Kang et al. | |
| 2009/0096739 | A1 | 4/2009 | Lan et al. | |
| 2010/0156955 | A1 * | 6/2010 | Kimura | 345/690 |
| 2010/0201719 | A1 * | 8/2010 | Kimura | 345/690 |
| 2010/0224878 | A1 * | 9/2010 | Kimura | 257/57 |
| 2010/0224880 | A1 * | 9/2010 | Kimura | 257/59 |

OTHER PUBLICATIONS

Extended European Search Report issued in Application No. 10189675.1, dated Feb. 25, 2011.

* cited by examiner

*Primary Examiner* — Fred Tzeng
(74) *Attorney, Agent, or Firm* — Sughrue Mion, PLLC

(57) ABSTRACT

A backlight unit and a display apparatus are provided. The display apparatus includes a power supply unit which outputs a first voltage; a light emitting unit which includes a first end connected to the power supply unit, and a second end, the first end receiving the first voltage from the power supply unit; and a compensation unit which includes a first end connected to the second end of the light emitting unit, and which compensates a deviation between the first voltage and a rated voltage of the light emitting unit.

26 Claims, 5 Drawing Sheets

BACKLIGHT UNIT AND DISPLAY APPARATUS

CROSS-REFERENCE TO RELATED APPLICATION

This application claims priority from Korean Patent Application No. 10-2009-114576, filed on Nov. 25, 2009, in the Korean Intellectual Property Office, the disclosure of which is incorporated herein by reference in its entirety.

BACKGROUND

1. Field

Apparatuses and methods consistent with exemplary embodiments relate to a backlight unit (BLU) and a display apparatus, and more particularly, to a BLU which displays an image using backlight radiated from a light emitting module in a display and a display apparatus.

2. Description of the Related Art

A liquid crystal display (LCD) panel cannot emit light by itself. Therefore, an LCD panel needs to have a backlight unit which provides backlight to the LCD panel.

The backlight unit includes a light emitting unit which generates backlight and a light guide plate which uniformly transmits backlight radiated from the light emitting unit onto a surface of the LCD panel. The light emitting unit includes light emitting elements which are disposed in order to efficiently provide backlight to the LCD panel and a driving element which drives the light emitting elements. An appropriate number of driving elements is provided to drive the light emitting elements without any problems.

A light emitting diode (LED) which offers high luminance, a long operating lifespan, and low thermal resistance in comparison with a cold cathode fluorescent lamp (CCFL) is mainly used as a light emitting element of a BLU. The LED can adjust its luminance using driving current supplied to the LED, and improve cognition and reduce power consumption by adjusting a voltage of a power supply unit.

In particular, since the brightness of an LED is proportional to the current supplied thereto, constant current should be supplied to enable each LED to produce uniform luminance, thereby stabilizing the luminance. Accordingly, to stabilize the luminance, each LED has to produce uniform luminance.

In order for the LEDs to produce the same luminance, the rated voltage needs to be equal at each LED. However, LEDs show a deviation of the rated voltage according to various factors such as dispersion errors and temperature change. Herein, the rated voltage is a forwarding voltage which is supplied to an LED for normal operation.

Therefore, there is a need for methods to compensate a deviation of rated voltage of an LED so that LED modules of a BLU produce uniform luminance.

SUMMARY

One or more exemplary embodiments address at least the above problems and/or disadvantages and other disadvantages not described above. Also, the exemplary embodiments are not required to overcome the disadvantages described above, and an exemplary embodiment of the may not overcome any of the problems described above.

Exemplary embodiments provide a BLU including a compensation unit which compensates a deviation between the voltage supplied by a power supply unit and the rated voltage of a light emitting unit, and a display apparatus.

According to an aspect of an exemplary embodiment, there is provided a display apparatus, including an image processing unit which processes a signal of an input image; a display panel which displays the image of the processed signal; and a BLU which provides backlight to the display panel, wherein the backlight unit comprises a power supply unit; a light emitting unit of which an end is connected to the power supply unit, and which receives a first voltage from the power supply unit; and a compensation unit of which an end is connected to an opposite end of the light emitting unit, and which compensates a deviation between the first voltage and the rated voltage of the light emitting unit.

The compensation unit may calculate the deviation between the first voltage and the rated voltage of the light emitting unit, and compensate the deviation between the first voltage and the rated voltage of the light emitting unit by maintaining the voltage of the compensation unit at the calculated voltage.

An opposite end of the compensation unit may be connected to the power supply unit, and supply an excess current to the power supply unit corresponding to the deviation between the first voltage and the rated voltage of the light emitting unit.

The compensation unit may include a capacitor which includes an end connected to the opposite end of the light emitting unit and an opposite end connected to ground; an inductor which includes an end connected to the capacitor and an opposite end connected to a switch; a switch which is connected to the inductor, and is turned on or off to adjust the voltage of the capacitor; and a controller which controls the switch to control the voltage of the capacitor in order to compensate the deviation between the first voltage and the rated voltage of the light emitting unit.

If the voltage of the capacitor is higher than a first threshold, the controller may control the switch to turn on, and if the voltage of the capacitor is lower than a second threshold, the controller may control the switch to turn off.

The controller may control the switch to turn on and off repeatedly in order to maintain the voltage supplied to the capacitor at a constant level.

The inductance of the inductor, the capacitance of the capacitor, and the rated power of the switch may be determined by the deviation between the first voltage and the rated voltage of the light emitting unit.

The compensation unit may further include a diode which comprises an end connected to the power supply unit and an opposite end connected between the switch and the inductor, and supply an excess current to the power supply unit corresponding to the deviation between the first voltage and the rated voltage of the light emitting unit.

The compensation unit may be fabricated on an integrated circuit (IC).

According to another aspect of an exemplary embodiment, there is provided a backlight unit, including a power supply unit; a light emitting unit of which an end is connected to the power supply unit, and which receives a first voltage from the power supply unit; and a compensation unit of which an end is connected to an opposite end of the light emitting unit, and which compensates a deviation between the first voltage and the rated voltage of the light emitting unit.

The compensation unit may calculate the deviation between the first voltage and the rated voltage of the light emitting unit, and compensate the deviation between the first voltage and the rated voltage of the light emitting unit by maintaining the voltage of the compensation unit at the calculated voltage.

An opposite end of the compensation unit may be connected to the power supply unit, and supply an excess current to the power supply unit corresponding to the deviation between the first voltage and the rated voltage of the light emitting unit.

The compensation unit may include a capacitor which includes an end connected to the opposite end of the light emitting unit and an opposite end connected to ground; an inductor which includes an end connected to the capacitor and an opposite end connected to a switch; a switch which is connected to the inductor, and is turned on or off to adjust the voltage of the capacitor; and a controller which controls the switch to control the voltage of the capacitor in order to compensate the deviation between the first voltage and the rated voltage of the light emitting unit.

If the voltage of the capacitor is higher than a first threshold, the controller may control the switch to turn on, and if the voltage of the capacitor is lower than a second threshold, the controller may control the switch to turn off.

The controller may control the switch to turn on and off repeatedly in order to maintain the voltage supplied to the capacitor at a constant level.

The inductance of the inductor, the capacitance of the capacitor, and the rated power of the switch may be determined by the deviation between the first voltage and the rated voltage of the light emitting unit.

The compensation unit may further include a diode which comprises an end connected to the power supply unit and an opposite end connected between the switch and the inductor, and supply an excess current to the power supply unit corresponding to the deviation between the first voltage and the rated voltage of the light emitting unit.

The compensation unit may be fabricated on an IC.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
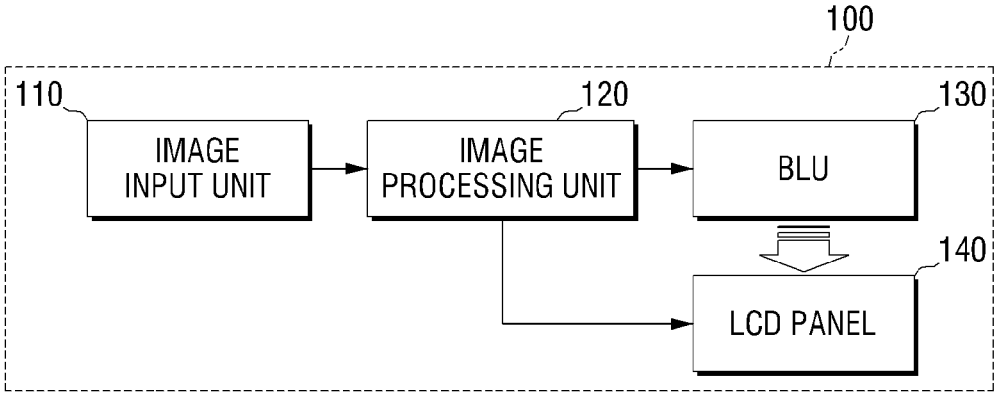
FIG. 1 is a block diagram illustrating an LCD apparatus according to an exemplary embodiment.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

FIG. 1 is a block diagram illustrating an LCD apparatus according to an exemplary embodiment. Referring to FIG. 1, the LCD apparatus 100 comprises an image input unit 110, an image processing unit 120, a BLU 130, and an LCD panel 140.

The image input unit 110 includes an interface (not shown) to be communicably linked to an external device, or an external system in a wired or wireless manner and receives an image from the external device or the external system. The image input unit 110 transmits the input image to the image processing unit 120.

The image processing unit 120 processes an image signal to be a proper format for the LCD panel 140 which will be explained later, and generates a brightness controlling signal which controls the brightness of the BLU 130. The image processing unit 120 processes a signal using video decoding, video scaling, and frame rate conversion (FRC) so that an input image is displayed, and then transmits the signal to the BLU 130 and the LCD panel 140.

The BLU 130 receives the signal generated by the image processing unit 120, drives light emitting units 220, and emits backlight to the LCD panel 140. The backlight unit 130 includes a circuit which drives the light emitting units 220 to emit backlight.

The backlight emitted by the light emitting units 220 enters a light guide plate, and the backlight passes through the light guide plate to the LCD panel 140.

The LCD panel 140 adjusts transmittance of the backlight produced by the BLU 130 to visualize an image signal, and displays an image on a screen. The LCD panel 140 includes two substrates on which electrodes are disposed facing each other, and a liquid crystal material interposed between the two substrates. If voltage is applied to the two electrodes, an electric field is formed on the substrates and thus causes molecules of the liquid crystal material interposed between the two substrates to move, thereby adjusting the transmittance of the backlight.

Figure 2:
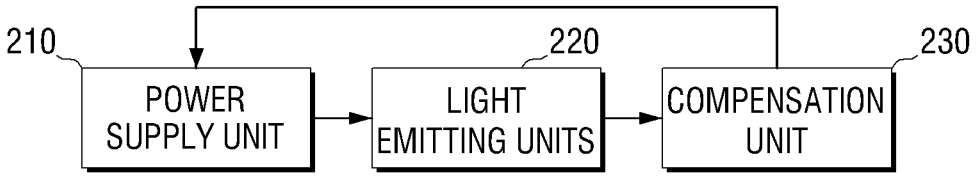
FIG. 2 is a block diagram of a circuit which drives light emitting modules in an LCD apparatus according to an exemplary embodiment.

A backlight unit according to an exemplary embodiment will be explained in more detail with reference to FIGS. 2 to 5. FIG. 2 is a block diagram of a circuit which drives light emitting modules in an LCD apparatus according to an exemplary embodiment.

Referring to FIG. 2, the circuit which drives the light emitting units 220 according to an exemplary embodiment includes a power supply unit 210, the light emitting units 220, and a compensation unit 230.

The power supply unit 210 supplies power to the light emitting units 220 in order to enable the light emitting units 220 to operate. If the rated voltage to operate a plurality of light emitting modules included in the light emitting unit 220 is equal at each light emitting module, the light emitting modules receive the same voltage from the power supply unit 210, thereby emitting light having the same luminance.

However, the plurality of light emitting units 220 in the LCD apparatus 100 may not have the same rated voltage due to errors caused by the manufacturing process or temperature changes. Therefore, the power supply unit 210 supplies a voltage that is higher than a maximum voltage among the rated voltages required by each light emitting unit 220 so that the plurality of light emitting units 220 in the LCD apparatus 100 provide the same luminance. For example, if a first light emitting unit requires a rated voltage of 25V, a second light emitting unit requires a rated voltage of 27V, a third light emitting unit requires a rated voltage of 26V, and a fourth light emitting unit requires a rated voltage of 28V, the power supply unit 210 supplies power having a voltage equal to or higher than 28V.

The light emitting unit 220 receives power from the power supply unit 210, and emits backlight. The plurality of light emitting units 220 included in the LCD apparatus 100 do not require the same rated voltage, but the light emitting units 220 emit backlight having uniform luminance because the compensation unit 230 compensates the voltage corresponding to a deviation of the rated voltage of each light emitting unit 220.

The compensation unit 230 compensates a deviation between the voltage supplied by the power supply unit 210 and the rated voltage of the light emitting unit 220. In more detail, the compensation unit 230 calculates a voltage corresponding to a deviation between the voltage supplied by the power supply unit 210 and the rated voltage of the light emitting unit 220. Based on the calculated voltage, the compensation unit 230 operates to maintain the compensation unit voltage at the calculated voltage. For instance, if the power supply unit 210 supplies a voltage of 30V, and the light emitting unit 220 requires a rated voltage of 28V, the compensation unit 230 calculates the deviation between the voltage supplied by the power supply unit 210 and the rated voltage of the light emitting unit 220 as 2V. The compensation unit 230 operates to maintain its voltage at 2V so that the rated voltage of 28V is supplied to the light emitting unit 220 as required. In such a manner, the compensation unit 230 compensates a deviation between the voltage supplied by the power supply unit 210 and the rated voltage of the light emitting unit 220.

The compensation unit 230 is connected to the power supply unit 210. The compensation unit 230 supplies to the power supply unit an excess current corresponding to a deviation between the voltage supplied by the power supply unit 210 and the rated voltage of the light emitting unit 220. The excess current is applied to the power supply unit 210, thereby increasing the power efficiency of the BLU 130.

Figure 3:
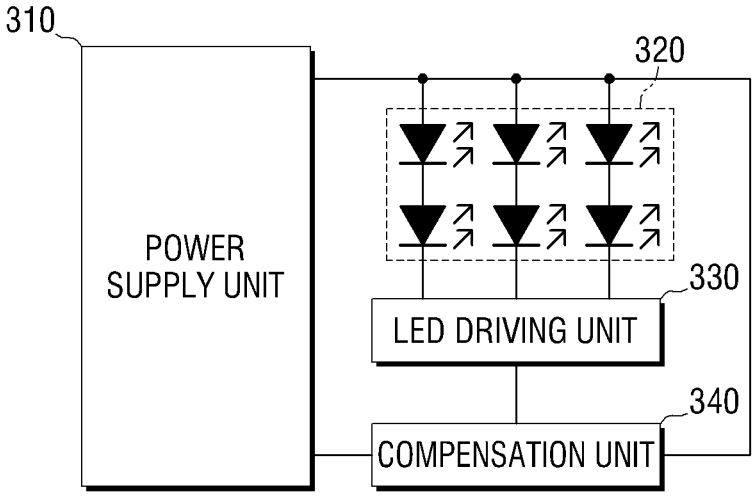
FIG. 3 is a simplified circuit diagram of a circuit which drives light emitting modules in an LCD apparatus according to an exemplary embodiment.

FIG. 3 is a circuit diagram of the BLU 130 according to an exemplary embodiment.

Referring to FIG. 3, the backlight unit 130 comprises a power supply unit 310, LED modules 320, an LED driving unit 330, and a compensation unit 340.

As shown in FIG. 3, the power supply unit 310 comprises a first end which is connected to the LED modules 320 and a second end which is connected to the compensation unit 340.

The power supply unit 310 supplies driving power to each LED module 320 to enable the LED modules 320 to operate. The power supply unit 310 provides a higher voltage than the maximum voltage among the rated voltages required by the LED modules 320 so that the LED modules 320 in the LCD apparatus 100 provide luminance of a predetermined level.

Each of the LED modules 320 comprises a first end which is connected to the power supply unit 310 and a second end which is connected to the LED driving unit 330. Each LED modules 320 in the LCD apparatus 100 may have a different rated voltage. However, the compensation unit 340 compensates a deviation of the rated voltage of each LED module 320, and thus the plurality of LED modules 320 may emit backlight having the same luminance.

The LED driving unit 330 is connected to each of the LED modules 320 in series to control a constant current of the LED module 320. Since the luminance of the LED module 320 is proportional to the current of the LED module 320, current balancing is required. Accordingly, the LCD apparatus 100 includes the LED driving unit 330 to supply a stable current to each of the LED modules 320.

The compensation unit 340 includes a first end which is connected to the LED driving unit 330 and a second end which is connected to the second end of the power supply unit 310.

As described above, the compensation unit 340 compensates a deviation between the voltage supplied by the power supply unit 310 and the rated voltage of the LED modules 320. In more detail, the compensation unit 340 detects a voltage corresponding to a deviation between the voltage supplied by the power supply unit 310 and the rated voltage of the LED module 320. The compensation unit 340 operates to maintain its voltage at the detected voltage to compensate a deviation between the voltage supplied by the power supply unit 310 and the rated voltage of the LED module 320.

The compensation unit 340 supplies to the power supply unit 310 an excess current corresponding to a deviation between the voltage supplied by the power supply unit 310 and the rated voltage of the LED module 320. The excess current is applied to the power supply unit 310, thereby increasing the power efficiency of the BLU 130.

Figure 4:
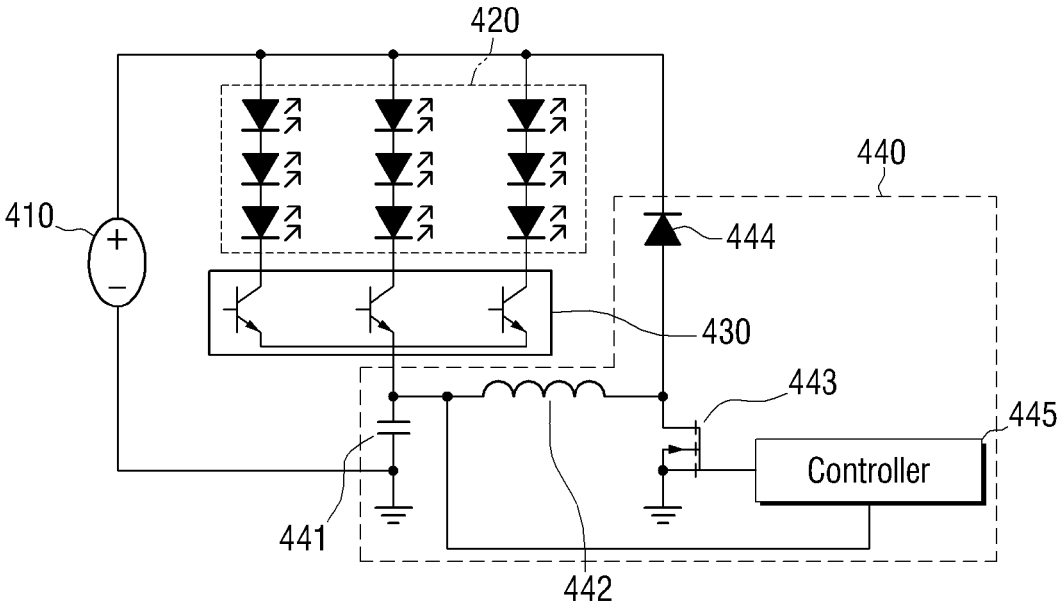
FIG. 4 is a circuit diagram of a circuit which drives light emitting modules in an LCD apparatus according to an exemplary embodiment.

FIG. 4 shows a circuit of the BLU 130 in detail according to an exemplary embodiment.

Referring to FIG. 4, the BLU 130 includes a power supply unit 410, LED modules 420, an LED driving unit 430, and a compensation unit 440.

The structure and the operation of the power supply unit 410, the LED modules 420, and the LED driving unit 430 are identical to those of FIG. 3.

As shown in FIG. 4, the compensation unit 440 includes a capacitor 441, an inductor 442, a switch 443, a diode 444, and a controller 445.

The capacitor 441 includes a first end which is connected to the LED driving unit 430 and a second end which is connected to ground. If the power supply unit 410 starts supplying power, the capacitor 441 is charged by a current flowing through the LED driving unit 430. Therefore, the voltage of the capacitor 441 is increased while the capacitor 441 is charged.

The voltage of the capacitor 441 is increased up to a first threshold voltage, not infinitely. If the voltage of the capacitor 441 is increased up to the first threshold voltage, the controller 445 controls the switch 443 to turn on. If the switch 443 is turned on, the capacitor 441 is discharged, and the voltage of the capacitor 441 is decreased.

The voltage of the capacitor 441 is decreased down to the second threshold voltage. In this case, if the voltage of the capacitor 441 is decreased down to the second threshold, the controller 445 controls the switch 443 to turn off. If the switch is turned off, the capacitor 441 is charged, and the voltage of the capacitor 441 is increased.

Accordingly, the repetitive operation of turning on and off the switch 443 enables the capacitor 441 to maintain a constant voltage between the first threshold and the second threshold. In particular, the constant voltage of the capacitor 441 corresponds to a deviation between the voltage supplied by the power supply unit 410 and the rated voltage of the LED module 420. Through the above operation, the compensation unit 440 compensates the deviation between the voltage supplied by the power supply unit 410 and the rated voltage of the LED module 420.

The inductor 442 includes a first end which is connected to the capacitor 441 and a second end which is connected to the switch 443. The inductor 442 temporarily stores energy while the capacitor 441 is charged and discharged repeatedly.

The switch 443 is connected to the second end of the inductor 442. As described above, the switch 443 is turned on and turned off repeatedly to adjust the voltage of the capacitor 441.

The diode 444 includes a first end which is connected to the power supply unit 410 and a second end which is connected between the switch 443 and the inductor 442. The diode 444 supplies to the power supply unit 410 an excess current corresponding to a deviation between the voltage supplied by the power supply unit 410 and the rated voltage of the LED module 420. The excess current is applied to the power supply unit 410, thereby increasing the power efficiency of the BLU 130.

The controller 445 calculates a voltage corresponding to a deviation between the voltage supplied by the power supply unit 410 and the rated voltage of the LED module 420. The controller 445 controls the switch 443 so that the capacitor 441 maintains its voltage at the calculated voltage.

Circuit elements of the compensation unit 440 are determined by a deviation between the voltage supplied by the power supply unit 410 and the rated voltage of the LED module 420, rather than by the rated voltage of the LED module 420 alone. For example, if the voltage supplied by the power supply unit 410 is 30V and the rated voltage of the LED module 420 is 28V, the capacitance, the inductance, and the internal voltage of the capacitor 441, the inductor 442, and the switch 443 which constitute the compensation unit 440 are determined depending on the 2V deviation, rather than the 28V of the rated voltage of the LED module 420 alone.

Accordingly, the price and size of the compensation unit 440 is reduced compared to a compensation unit in which the circuit elements are determined by the rated voltage of the LED module 420. The small size of the compensation unit 440 makes it possible to fabricate the compensation unit 440 as an integrated circuit (IC), thereby facilitating slimness of the display apparatus.

Figure 5:
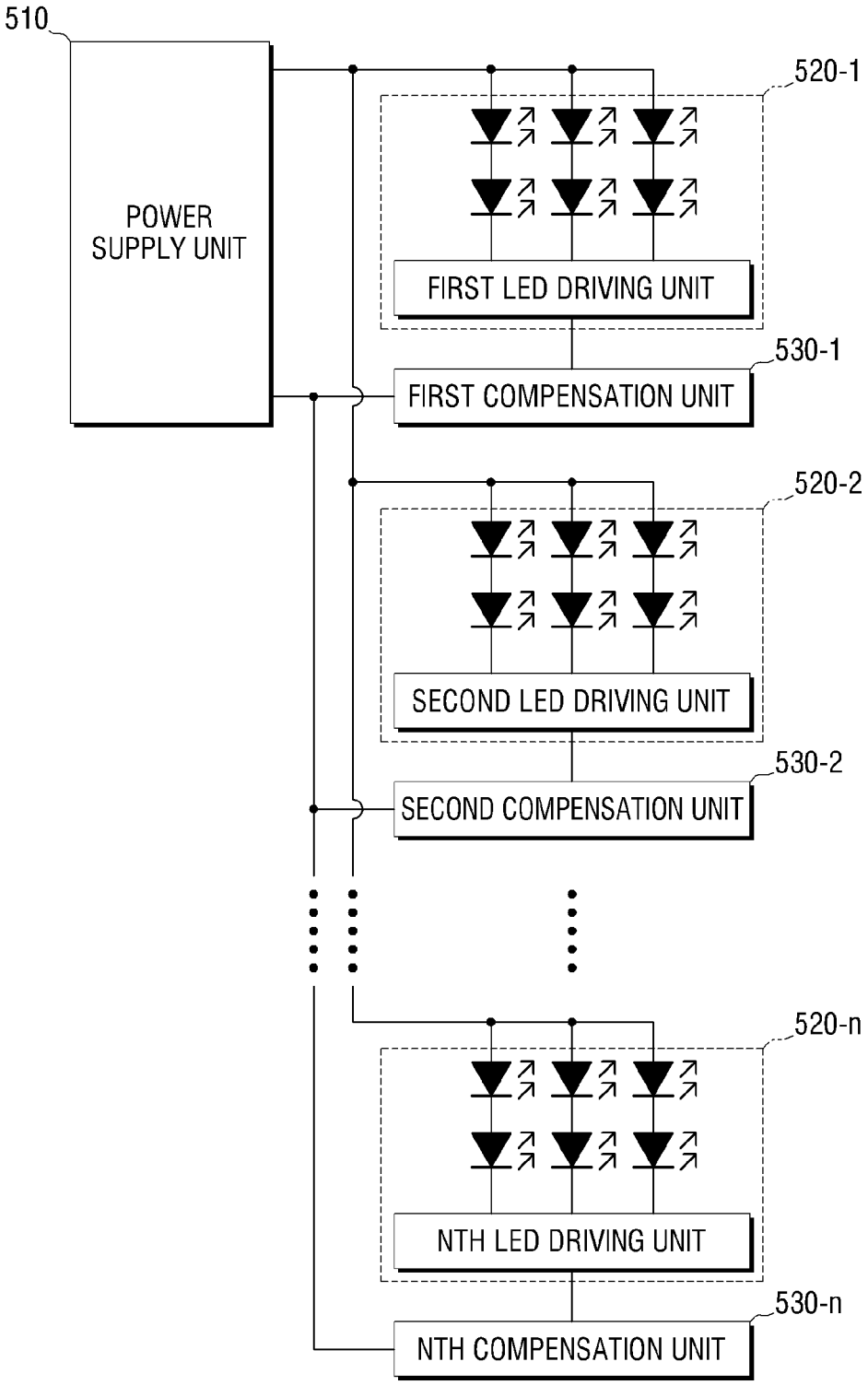
FIG. 5 is a circuit diagram of a circuit which drives light emitting modules in an LCD apparatus having a circuit to drive a plurality of light emitting modules according to an exemplary embodiment.

FIG. 5 is a circuit diagram of a circuit which drives a plurality of light emitting units 520-1, 520-2, . . . **520-*n*** according to an exemplary embodiment.

Referring to FIG. 5, the circuit which drives the plurality of light emitting units 520-1, 520-2, . . . **520-*n* includes a power supply unit 510, the plurality of light emitting units 520-1, 520-2, . . . 520-*n*, and a plurality of compensation units 530-1, 530-2, . . . 530-*n***.

The power supply unit 510 supplies driving power to each of the plurality of light emitting units 520-1, 520-2, . . . **520-*n* to operate them. The plurality of light emitting units 520-1, 520-2, . . . 520-*n*** may not have the same rated voltage due to errors caused by the fabrication process and errors caused by temperature conditions.

Therefore, the power supply unit supplies a voltage higher than the maximum voltage among the rated voltages required by each of the light emitting units 520-1, 520-2, . . . **520-*n* so that the plurality of light emitting units 520-1, 520-2, . . . 520-*n* offer the same luminance. For example, if the first light emitting unit 520-1 requires a rated voltage of 25V, the second light emitting unit 520-2 requires a rated voltage of 27V, the third light emitting unit 520-3 requires a rated voltage of 26V, and the fourth light emitting unit 520-4 requires a rated voltage of 28V, the power supply unit 510** supplies power having a voltage equal to or higher than 28V.

The plurality of light emitting units 520-1, 520-2, . . . **520-*n* receive power from the power supply unit 510, and emit backlight. Even if the plurality of light emitting units 520-1, 520-2, . . . 520-*n* do not require the same rated voltage, the plurality of light emitting units 520-1, 520-2, . . . 520-*n* emit backlight having the same luminance since the plurality of compensation units 530-1, 530-2, . . . 530-*n* compensate the voltage corresponding to a deviation between the voltage supplied by the power supply unit 510 and the rated voltage of each of the light emitting units 520-1, 520-2, . . . 520-*n***.

The plurality of compensation units 530-1, 530-2, . . . **530-*n* compensate a deviation between the voltage supplied by the power supply unit 510 and the rated voltage of each of the light emitting units 520-1, 520-2, . . . 520-*n*. In more detail, the plurality of compensation units 530-1, 530-2, . . . 530-*n* calculate the voltage corresponding to a deviation between the voltage supplied by the power supply unit 510 and the rated voltage of each of the light emitting units 520-1, 520-2, . . . 520-*n*. Based on the calculated voltage, the plurality of compensation units 530-1, 530-2, . . . 530-*n*** operate to maintain their voltage at the calculated voltage.

For instance, if the power supply unit 510 supplies a voltage of 30V, and the first light emitting unit 520-1 requires a rated voltage of 28V, the first compensation unit 530-1 calculates 2V as a deviation between the voltage supplied by the power supply unit 510 and the rated voltage of the first light emitting unit 520-1. The first compensation unit 530-1 operates to maintain its voltage at 2V so that the rated voltage of 28V is supplied to the first light emitting unit 520-1 as required. In such a manner, the first compensation unit 530-1 compensates a deviation between the voltage supplied by the power supply unit 510 and the rated voltage of the first light emitting unit 520-1.

In the same manner, if the power supply unit 510 supplies voltage of 30V, and the second light emitting unit 520-2 requires a rated voltage of 26V, the second compensation unit 530-2 calculates 4V as a deviation between the voltage supplied by the power supply unit 510 and the rated voltage of the second light emitting unit 520-2. The second compensation unit 530-2 operates to maintain its voltage at 4V so that the rated voltage of 26V is supplied to the second light emitting unit 520-2 as required. In such a manner, the second compensation unit 530-2 compensates a deviation between the voltage supplied by the power supply unit 510 and the rated voltage of the second light emitting unit 520-2.

The other compensation units 530-3, 530-4, . . . **530-*n* compensate a deviation between the voltage supplied by the power supply unit 510 and the rated voltage of each of the light emitting units 520-3, 520-4, . . . 520-*n*** in the same manner described above.

The plurality of compensation units 530-1, 530-2, . . . **530-*n* are connected to the power supply unit 510. The plurality of compensation units 530-1, 530-2, . . . 530-*n* supply an excess current to the power supply unit 510 corresponding to a deviation between the voltage supplied by the power supply unit 510 and the rated voltage of each of the light emitting units 520-1, 520-2, . . . 520-*n*. The excess current applied to the power supply unit 310 thereby increases the power efficiency of the BLU 130**.

According to the diverse exemplary embodiments, the LCD apparatus 100 is provided as a display apparatus, but this is merely exemplary. The present technical idea may be applied to other light emitting modules in addition to the LCD module.

In the exemplary embodiments, the compensation unit includes the capacitor 441, the inductor 442, the switch 443, the diode 444, and the controller 445, but this is merely exemplary. The technical idea may be applied to any circuits which perform the same functions as those of the circuits in the exemplary embodiments.

The technical idea may also be applied only when a BLU is implemented as well as when a display apparatus is implemented.

As described above, according to the various exemplary embodiments, a plurality of components of the compensation unit are determined by a deviation between the power supplied by the power supply unit and the rated voltage of the light emitting unit, not by the rated voltage of the light emitting unit. Therefore, the price of the compensation unit may be lowered, and the size of the compensation unit may be reduced, thereby enabling the compensation unit to be fabricated on an IC.

Since an excess current is applied to the power supply unit, the efficiency of the electricity to drive the circuit may be increased.

The foregoing exemplary embodiments and aspects are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus comprising:

an image processing unit which processes an image signal;

a display panel which displays an image corresponding to the processed image signal; and a backlight unit (BLU) which provides backlight to the display panel, wherein the backlight unit comprises:

a power supply unit which outputs a first voltage;

a light emitting unit which includes a first end and a second end, the first end of the light emitting unit being connected to the power supply unit and receiving the first voltage output from the power supply unit; and a compensation unit which includes a first end connected to the second end of the light emitting unit, and which compensates a deviation between the first voltage and a rated voltage of the light emitting unit.

2. The display apparatus of claim 1, wherein the compensation unit determines the deviation between the first voltage and the rated voltage of the light emitting unit, and compensates the deviation between the first voltage and the rated voltage of the light emitting unit by maintaining a voltage of the compensation unit at the determined voltage.

3. The display apparatus of claim 1, wherein the compensation unit further includes a second end connected to the power supply unit, and supplies to the power supply unit an excess current corresponding to the deviation between the first voltage and the rated voltage of the light emitting unit via the second end.

4. The display apparatus of claim 1, wherein the compensation unit comprises:

a capacitor which includes a first end connected to the second end of the light emitting unit, and a second end connected to ground;

an inductor which includes a first end connected to the first end of the capacitor, and a second end; and a switch which is connected to the second end of the inductor, and is turned on or off to adjust a voltage of the capacitor.

5. The display apparatus of claim 4, wherein the compensation unit further comprises:

a controller which controls the switch to turn on or off to control the voltage of the capacitor to compensate the deviation between the first voltage and the rated voltage of the light emitting unit.

6. The display apparatus of claim 5, wherein if the voltage of the capacitor is higher than a first threshold, the controller controls the switch to turn on, and if the voltage of the capacitor is lower than a second threshold, the controller controls the switch to turn off.

7. The display apparatus of claim 6, wherein the controller controls the switch to turn on and off repeatedly in order to maintain the voltage of the capacitor between the first threshold and the second threshold.

8. The display apparatus of claim 5, wherein an inductance of the inductor, a capacitance of the capacitor, and a rated power of the switch correspond to the deviation between the first voltage and the rated voltage of the light emitting unit.

9. The display apparatus of claim 5, wherein the compensation unit further comprises:

a diode which includes a first end connected to the power supply unit, and a second end connected to the second end of the inductor, wherein the diode supplies to the power supply unit an excess current corresponding to the deviation between the first voltage and the rated voltage of the light emitting unit.

10. The display apparatus of claim 1, wherein the compensation unit is disposed on an integrated circuit.

11. A backlight unit comprising:

a power supply unit which outputs a first voltage;

a light emitting unit which includes a first end and a second end, the first end of the light emitting unit being connected to the power supply unit and receiving the first voltage output from the power supply unit; and a compensation unit which includes a first end connected to the second end of the light emitting unit, and which compensates a deviation between the first voltage and a rated voltage of the light emitting unit.

12. The backlight unit of claim 11, wherein the compensation unit determines the deviation between the first voltage and the rated voltage of the light emitting unit, and compensates the deviation between the first voltage and the rated voltage of the light emitting unit by maintaining a voltage of the compensation unit at the determined voltage.

13. The backlight unit of claim 11, wherein the compensation unit further includes a second end connected to the power supply unit, and supplies to the power supply unit an excess current corresponding to the deviation between the first voltage and the rated voltage of the light emitting unit via the second end.

14. The backlight unit of claim 11, wherein the compensation unit comprises:

a capacitor which includes a first end connected to the second end of the light emitting unit, and a second end connected to ground;

an inductor which includes a first end connected to the first end of the capacitor, and a second end; and a switch which is connected to the second end of the inductor, and is turned on or off to adjust a voltage of the capacitor.

15. The backlight unit of claim 14, wherein the compensation unit further comprises:

a controller which controls the switch to turn on or off to control the voltage of the capacitor to compensate the deviation between the first voltage and the rated voltage of the light emitting unit.

16. The backlight unit of claim 14, wherein if the voltage of the capacitor is higher than a first threshold, the controller controls the switch to turn on, and if the voltage of the capacitor is lower than a second threshold, the controller controls the switch to turn off.

17. The backlight unit of claim 16, wherein the controller controls the switch to turn on and off repeatedly in order to maintain the voltage of the capacitor between the first threshold and the second threshold.

18. The backlight unit of claim 14, wherein an inductance of the inductor, a capacitance of the capacitor, and a rated power of the switch correspond to the deviation between the first voltage and the rated voltage of the light emitting unit.

19. The backlight unit of claim 14, wherein the compensation unit further comprises:

a diode which includes a first end connected to the power supply unit, and a second end connected to the second end of the inductor, wherein the diode supplies to the power supply unit an excess current corresponding to the deviation between the first voltage and the rated voltage of the light emitting unit.

20. The backlight unit of claim 11, wherein the compensation unit is disposed on an integrated circuit.

21. A compensation unit that compensates a deviation between a first voltage received by a light emitting unit and a rated voltage of the light emitting unit, the compensation unit comprising:

a capacitor which includes a first end and a second end, the first end of the capacitor being connected to an end of the light emitting unit and the second end of the capacitor being connected to ground;

an inductor which includes a first end and a second end, the first end of the inductor being connected to the first end of the capacitor; and a switch which is connected to the second end of the inductor, and is turned on or off to adjust a voltage of the capacitor.

22. The compensation unit of claim 21, further comprising a controller which controls the switch to turn on or off to control the voltage of the capacitor to compensate the deviation between the first voltage and the rated voltage of the light emitting unit.

23. The compensation unit of claim 22, wherein if the voltage of the capacitor is higher than a first threshold, the controller controls the switch to turn on, and if the voltage of the capacitor is lower than a second threshold, the controller controls the switch to turn off.

24. The compensation unit of claim 23, wherein the controller controls the switch to turn on and off repeatedly in order to maintain the voltage of the capacitor between the first threshold and the second threshold.

25. The compensation unit of claim 21, wherein an inductance of the inductor, a capacitance of the capacitor, and a rated power of the switch correspond to the deviation between the first voltage and the rated voltage of the light emitting unit.

26. The compensation unit of claim 21, wherein the compensation unit further comprises:

a diode which includes a first end connected to the power supply unit and a second end connected to the second end of the inductor, and which supplies an excess current to the power supply unit corresponding to the deviation between the first voltage and the rated voltage of the light emitting unit.

* * * * *